US007743577B2

(12) United States Patent
Ollman et al.

(10) Patent No.: US 7,743,577 B2
(45) Date of Patent: Jun. 29, 2010

(54) STRUCTURAL TRUSS WITH CRIMP/CLAMP METHOD OF MAKING SAME

(76) Inventors: Melvin L. Ollman, P.O. Box 1370, Marco Island, FL (US) 34146; Larry Hunsicker, 1413 Maple Ave. N., Lehigh Acres, FL (US) 33972

( * ) Notice: Subject to any disclaimer, the term of this patent is extended or adjusted under 35 U.S.C. 154(b) by 1056 days.

(21) Appl. No.: 11/268,785

(22) Filed: Nov. 8, 2005

(65) Prior Publication Data

US 2006/0080931 A1 Apr. 20, 2006

Related U.S. Application Data

(63) Continuation-in-part of application No. 10/919,601, filed on Aug. 17, 2004, now Pat. No. 7,228,670.

(60) Provisional application No. 60/496,067, filed on Aug. 18, 2003.

(51) Int. Cl.
*E04H 12/00* (2006.01)

(52) U.S. Cl. ..... 52/650.1; 52/633; 52/637

(58) Field of Classification Search ..... 52/650.1, 52/633, 634, 637, 694

See application file for complete search history.

(56) References Cited

U.S. PATENT DOCUMENTS

| | | | | | |
|---|---|---|---|---|---|
| 1,865,059 | A * | 6/1932 | Ragsdale | 52/691 |
| 1,983,632 | A * | 12/1934 | Eroskey et al. | 52/694 |
| 2,146,540 | A * | 2/1939 | Burke et al. | 52/693 |
| 2,256,812 | A * | 9/1941 | Miller | 29/897.31 |
| 3,882,653 | A * | 5/1975 | Ollman | 52/694 |
| 4,030,256 | A * | 6/1977 | Ollman | 52/93.1 |
| 5,003,748 | A * | 4/1991 | Carr | 52/693 |
| 6,758,022 | B1 * | 7/2004 | Coll et al. | 52/690 |
| 6,993,881 | B1 * | 2/2006 | Ruble et al. | 52/692 |
| 7,228,670 | B2 * | 6/2007 | Ollman | 52/633 |

* cited by examiner

*Primary Examiner*—Basil Katcheves
(74) *Attorney, Agent, or Firm*—Edward M. Livingston, Esq.; Bryan L. Loeffler, Esq.; The Livingston Firm

(57) ABSTRACT

A structural truss (3) with crimp/clamp (18) and method of making same wherein the truss (3) includes disposed U-shaped channel chords (2) and struts (1) interconnected to one another at alternately extending apices (6) wherein successive segments of the struts (1) have U-shapes and inverted U-shapes at their mid-sections and flat apices (6) at their respective ends. The ends (4) of successive segments of the unit lengths of the struts (1) and the chords (2) have holes for the insertion of a tapered pin (9), thus precisely controlling the length of successive trusses. The truss member (3) also has vertical load-bearing strut sections (17) at the end of each manufactured length of truss (3) to support a cantilevered section of chord (10). The crimp/clamp (18) is crimped and clamped onto the chords (2) so as to clamp the struts (1) to the chords (2).

7 Claims, 3 Drawing Sheets

STRUCTURAL TRUSS WITH CRIMP/CLAMP METHOD OF MAKING SAME

CROSS REFERENCE TO RELATED APPLICATION

This application is a continuation in part of application Ser. No. 10/919,601, filed on Aug. 17, 2004 now U.S. Pat. No. 7,228,670 which claims the benefit of U.S. Provisional Application No. 60/496,067, filed Aug. 18, 2003.

BACKGROUND OF THE INVENTION

This invention relates to trusses, more specifically, an improved open web structural truss and process of making same.

Conventional structural trusses and methods of making same are difficult in some respects.

First, the truss members of predetermined length, as described in U.S. Pat. No. 3,827,117, comprise oppositely disposed U-shaped channels between which a strut member is positioned, comprising alternately extending strut segments having flat end portions which are generally U-shaped in a cross section at the center and gradually tapering toward the flat end portions at the end. The strut member is then bent at the flat portions to form alternately extending apices which contact the opposing chord elements. When this is done, however, the opposite apices become substantially different in shape, thereby materially affecting the quality of their connections to the opposing chords. Thus, there exists a need for improvement in the quality of those connections.

Second, current production machines for the manufacturing of trusses, as described in U.S. Pat. Nos. 3,827,117 and 3,961,738, teach using preset lengths and quantities of trusses being formed continuously on the production machinery as controlled by a computer program. Although these machines efficiently manufacture the truss members described in the cited prior art at low cost with a minimum of labor and in a manner to provide uniformity and utility, these machines do not provide the following capabilities: a) providing a means for precise location for fastening struts and chords, b) providing a means for precisely measuring the distance points from apex to apex, and c) providing a vertical member for the support of the cantilevered ends of each truss length.

Finally, the quality of current trusses may be compromised at connecting points of strut and chords because of lack of uniformity of the shape of strut apices.

The prior art includes the following U.S. patents:

| Patent No. | Inventor | Assignee | Filing Date | Issue Date |
|---|---|---|---|---|
| D230,265 | Ollman | C-O, Inc. | Aug. 11, 1971 | Feb. 05, 1974 |
| 3,882,653 | Ollman | C-O, Inc. | Mar. 16, 1973 | May 13, 1975 |
| 3,827,117 | Ollman | C-O, Inc. | Apr. 11, 1973 | Aug. 06, 1974 |
| 3,961,738 | Ollman | C-O, Inc. | Jul. 01, 1974 | Jun. 08, 1976 |
| 4,030,256 | Ollman | N/A | Nov. 20, 1975 | Jun. 21, 1977 |

SUMMARY OF THE INVENTION

The primary object of the present invention is to provide an improved structural truss that will provide for improved connections of strut apices to the opposing chords.

A further object of the present invention is to provide an improved apparatus for making identically shaped strut apices contacting each of the opposing truss chords.

An even further object of the present invention is to provide an improved apparatus for making truss members which provides a means for precisely measuring the distance points from apex to apex.

A further object of the present invention is to provide an improved apparatus for making truss strut members which provides a load-bearing vertical member for the support of the cantilevered end of each truss.

An even further object of the present invention is to provide an improved structural truss with crimp/clamp method that provides both horizontal and lateral strength to the strut/chord connection.

The present invention fulfills the above and other objects by providing two improved strut segments where one strut segment is inverted U-shaped and the other is U-shaped. By having segments with both a U-shape and inverted U-shape, those portions of the strut contacting the opposing chords will have identically-shaped flat sections to facilitate the joining of the strut and the chords.

The present invention further fulfills the above objectives by providing a method for making the U-shaped sections of the advancing strut form alternate U-shape and inverted U-shaped sections of each segment in the strut unit length. The method invention involves providing unit length standards for both strut and chord by punching identically sized and located holes at each segment end of successive unit lengths of struts and of chords. As the separate elements of strut and chords reach the point of joining one to the other, a tapered pin will align the strut and chord by entering a first hole on the chord and then a second hole on the strut to precisely join the elements at a prescribed standard unit length. In addition, terminating strut sections of each truss are truncated to form vertical load-bearing strut segments for the preceding and succeeding truss cantilevered ends.

The above and other objects, features, and advantages of the present invention should become even more readily apparent to those skilled in the art upon a reading of the following detailed description in conjunction with the drawings wherein there is shown and described illustrative embodiments of the invention.

BRIEF DESCRIPTION OF DRAWINGS

This invention is described by appended claims in relation to a description of a preferred embodiment with reference to the following drawings which are explained briefly as follows:

DESCRIPTION OF PREFERRED EMBODIMENT

Listed numerically below with reference to the drawings are terms used to describe features of this invention. These terms and numbers assigned to them designate the same features throughout this description.

| | |
|---|---|
| 1. | strut member |
| 2. | u-shaped channel/chord |
| 3. | truss member |
| 4. | flat end portion |
| 5. | intermediate portion |
| 6. | apex |
| 7. | open end |
| 8. | closed end |
| 9. | tapered pin |
| 10. | end of chord |
| 11. | notch |
| 12. | cantilevered end |
| 13. | hollow rivet |
| 14. | middle |
| 15. | first end |
| 16. | second end |
| 17. | end strut member |
| 18. | crimp/clamp |
| 19. | centering hole |
| 20a. | punch |
| 20b. | punch |

Figure 1:
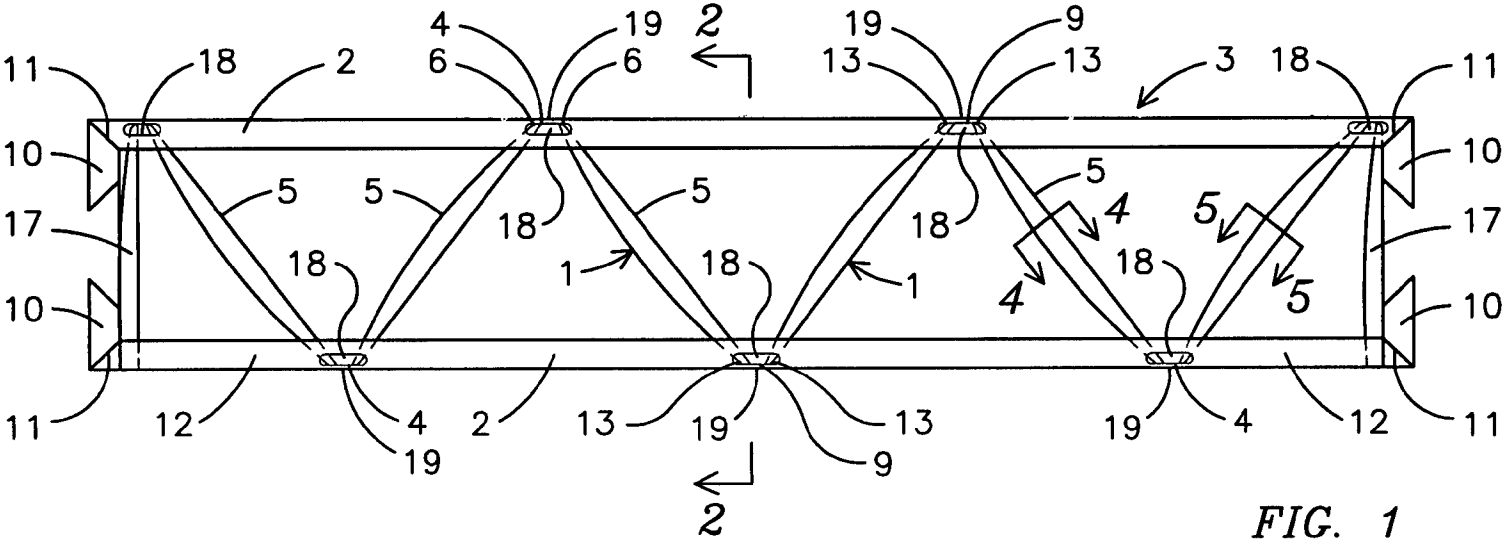
FIG. 1 is a side elevational plan view of the present invention.
Figure 2:
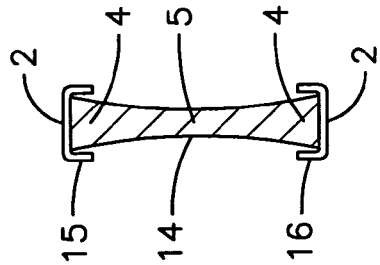
FIG. 2 is a cross sectional view along the line 2-2 of the embodiment of FIG. 1.

With reference to FIGS. 1 and 2, an improved structural truss of the present invention is shown. The improved truss has a plurality of strut members 1 having a first end 15, a middle 14 and a second end 16. The struts 1 have flat end portions 4 on the first end 15 and the second end 16 and are connected by non-flat intermediate portions 5 which are U-shaped or inverse U-shaped. The strut member 1 is bent at the flat portions 4 to form alternately extending apices 6. The apices 6 of the strut members 1 are connected to the U-shaped channels 2 to form the truss member 3 at its cantilevered end. The U-shaped chord channels 2 have notches 11 punched out in equal distances from one another. The notches 11 are adjacent to the end pieces 6 of the truss member 3 and provide for bending the ends 10 of the chord channels 2 inward around an end strut member 17 to define and provide strength to each truss member 3. The strut apex 6 and each end of the chords 2 have centering holes 19 to accommodate a tapered pin 9. The tapered pins 9 are used to precisely locate the end points of each unit length of the truss member 3. Each truss member 3 has cantilevered ends 12 to form each truss member 3. Apices 6 of the strut 1 will be secured to each chord 2 by using a fastening means, such as hollow rivets 13 located on both sides of the tapered pins 9. A hollow rivet 13 also centers the strut 1 within the chord 2. A strut apex 6 may then be crimped and clamped onto the chord 2 so as to provide additional structural reinforcement for the improved structural truss. The last strut members 17 on each end in a truss member 3 is bent perpendicularly to the chord 2 and the ends of each chord 10 are bent at a notch 11 to provide closed ends to the truss members 3.

Figure 3:
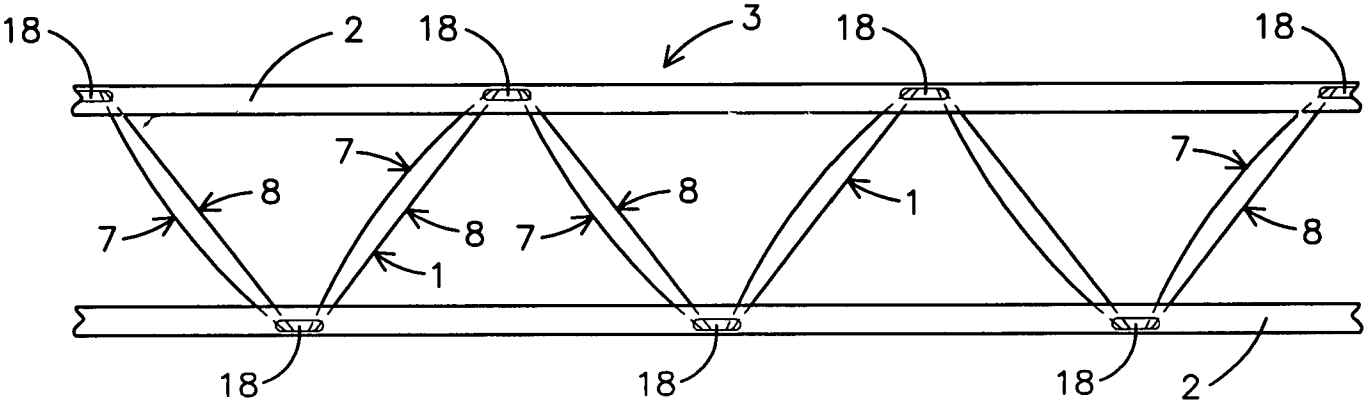
FIG. 3 is a side view of the improved truss of the present invention as a strut is inserted between the chords.

In FIG. 3, truss member 3 is shown with the strut member 1 inserted between the chords 2. The U-shaped portions of the struts 1 alternate in different directions, an open end 7 and a closed end 8, so that those portions of the strut members 1 contacting the chord 2 will be identical in shape.

Figure 5:
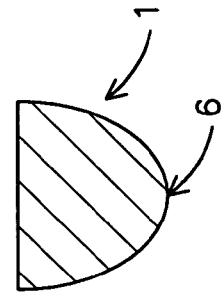
FIG. 5 is a cross sectional view along the line 5-5 of the embodiment of FIG. 1.
Figure 4:
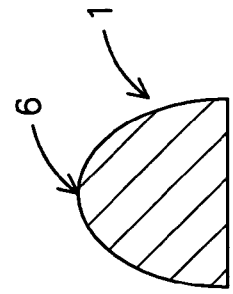
FIG. 4 is a cross sectional view along the line 4-4 of the embodiment of FIG. 1.

With reference to FIGS. 4 and 5, cross sectional views of alternating strut members 1 are shown to have inverse U-shaped and U-shaped features, respectively. This feature achieves a higher quality of strut member 1 to chord 10 connection by creating identically shaped apices 6.

Figure 6:
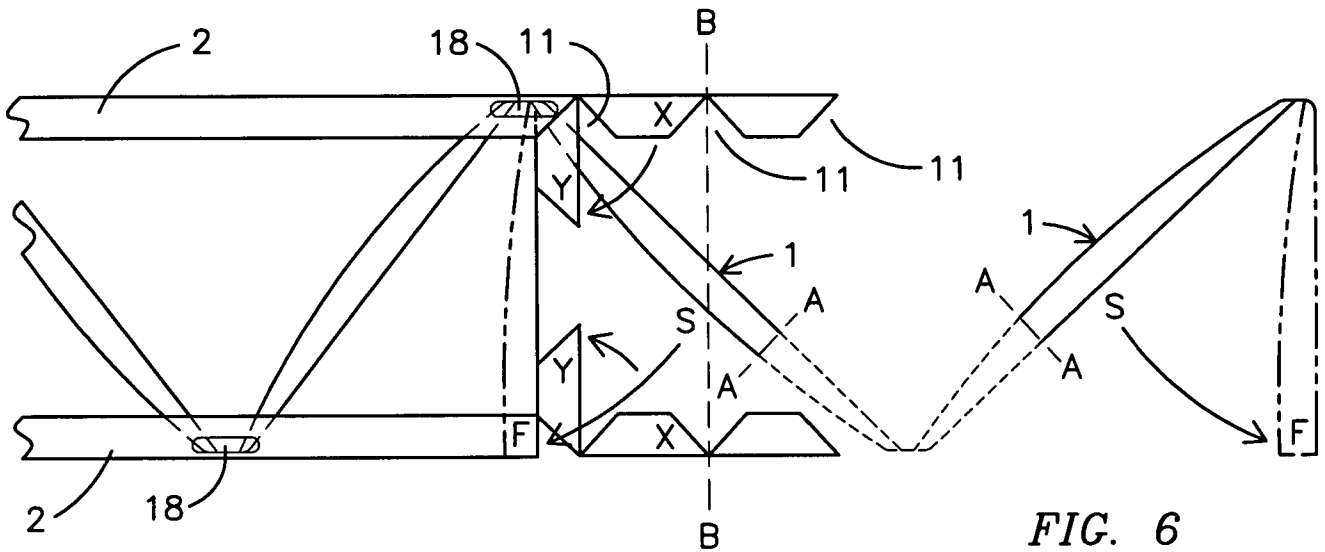
FIG. 6 is a cutaway side view of the present invention illustrating the operations performed on a cut strut and cut channel of the present invention.

With reference to FIG. 6, the method employed in fabricating the truss members of the present invention is described. First, a cut is made on the strut member 1 along lines A-A. The cut struts 17 are then folded from positions S to positions F. Then, another cut is made along line B-B through the U-shaped chord 2. Because the strut 1 was already folded, the cut along B-B will not cut the strut members 1. The U-shaped channel chords ends 10 are then bent from positions X to positions Y to form the truss member 1.

Figure 7:
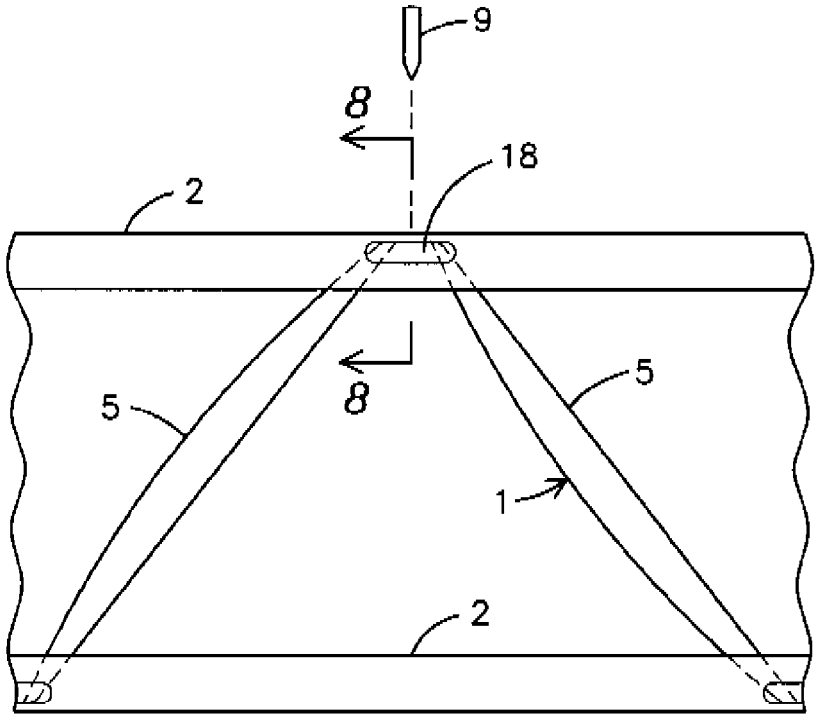
FIG. 7 is a side plan view of the crimp/clamp method of the present invention.

In FIG. 7, a side plan view of the attachment of strut 1 to chord 2 is shown. As noted above, the apices 6 of the strut 1 may be secured to each chord 2 by using a fastening means, such as hollow rivets 13, located on both sides of the tapered pin 9. However, the attachment method shown has dimples created by crimping/clamping 18 sides of chord 2 inward into the strut 1 apex 6, thus clamping the strut 1 to the chord 2.

Figure 8:
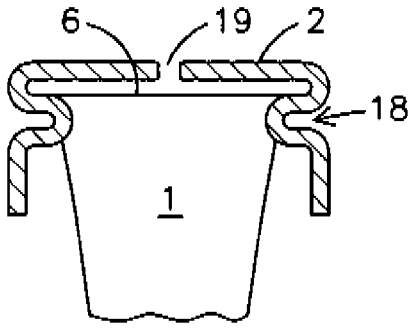
FIG. 8 is a cross sectional view along the line 8-8 of the embodiment of FIG. 7.

FIG. 8 shows a cross-sectional view along line 8-8 of the embodiment of FIG. 7 wherein the attachment is achieved by crimping the chord 2 and clamping the strut apice 6 to the chord 2. Centering holes 19 are located in the chord 2 and strut 1 for the acceptance of a tapered pin 9.

Figure 9:
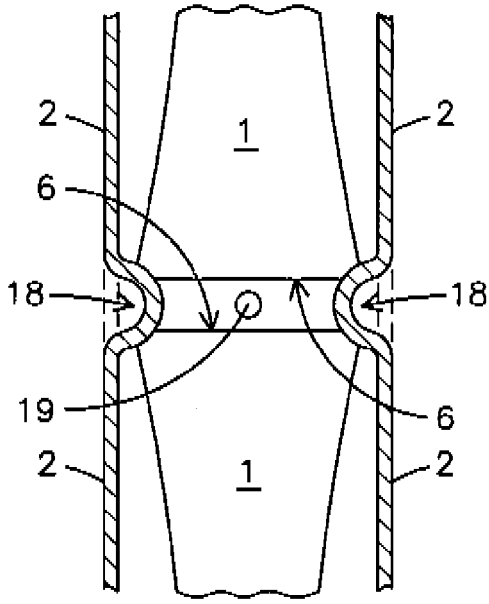
FIG. 9 is an upward looking view of the crimp/clamp method of the present invention.

FIG. 9 shows an upward looking view of the crimp/clamp 18 method of the present invention.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

The invention claimed is:

1. A structural truss comprising:

at least two strut members having at least two alternately extending struts;

said at least two alternately extending struts having a first end, a middle and a second end;

said at least two alternately extending struts having a flat end portion on said first end and a flat end portion on said second end;

said flat end portion on said first end is connected to said flat end portion on said second end by at least one first non-flat intermediate portion and at least one second non-flat intermediate portion;

said at least one first non-flat intermediate portion is U-shaped;

said at least one second non-flat intermediate portion is inverse U-shaped;

said at least two flat end portions are fastened to at least two chords;

at least two chords that are substantially U-shaped;

said at least two chords are secured to said at least two strut members via at least one dimple extending into the at least two chords and the at least two strut members; and said at least two chords are parallel in relation to one another.

2. The structural truss of claim 1 wherein:

said at least two extending struts are bent at said at least two flat portions to form a pair of alternately extending apices.

3. The structural truss of claim 2 wherein:

said at least two chords have at least one hole; and said apices have at least one hole.

4. The structural truss of claim 1 wherein:

said at least two chords have at least one notch per chord.

5. The structural truss of claim 4 wherein:

said at least one notch per chord is adjacent to said apices.

6. The structural truss of claim 5 wherein:

said apices have at least one hole.

7. The structural truss of claim 1 wherein:

said at least two chords have at least one hole.

* * * * *